US007790223B2

(12) United States Patent
Yamaguchi et al.

(10) Patent No.: US 7,790,223 B2
(45) Date of Patent: Sep. 7, 2010

(54) RECORDING MEDIUM FOR INK AND METHOD FOR PRODUCING THE SAME

(75) Inventors: Kenichi Yamaguchi, Chiba (JP); Shigehira Iida, Chiba (JP); Tsuyoshi Santo, Kanagawa (JP); Yuji Kondo, Tokyo (JP); Motoaki Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 739 days.

(21) Appl. No.: 11/687,906

(22) Filed: Mar. 19, 2007

(65) Prior Publication Data

US 2007/0166487 A1 Jul. 19, 2007

Related U.S. Application Data

(60) Division of application No. 10/678,143, filed on Oct. 6, 2003, now Pat. No. 7,255,901, which is a continuation of application No. PCT/JP03/07000, filed on Jun. 3, 2003.

(30) Foreign Application Priority Data

Jun. 4, 2002 (JP) ..... 2002-162910

(51) Int. Cl.
*B41M 5/50* (2006.01)

(52) U.S. Cl. ..... 427/152; 428/32.24; 428/32.26; 428/32.34

(58) Field of Classification Search ..... None
See application file for complete search history.

(56) References Cited

U.S. PATENT DOCUMENTS

| | | | | |
|---|---|---|---|---|
| 4,202,870 | A | 5/1980 | Weber et al. | 423/630 |
| 4,242,271 | A | 12/1980 | Weber et al. | 260/448 AD |
| 4,248,852 | A | 2/1981 | Wakabayashi et al. | 423/626 |
| 4,313,124 | A | 1/1982 | Hara | 346/140 R |
| 4,345,262 | A | 8/1982 | Shirato et al. | 346/140 R |
| 4,463,359 | A | 7/1984 | Ayata et al. | 346/1.1 |

(Continued)

FOREIGN PATENT DOCUMENTS

| | | |
|---|---|---|
| EP | 0 732 219 A2 | 9/1996 |

(Continued)

*Primary Examiner*—Bruce H Hess
(74) *Attorney, Agent, or Firm*—Fitzpatrick, Cella, Harper & Scinto

(57) ABSTRACT

The invention provides a recording medium for ink having an ink absorbing ability capable of absorbing ink of a large amount at a high speed, showing an excellent color forming ability and capable of suppressing an image deterioration by a dye displacement which tends to appear particularly in an image storage under a high humidity condition, and an image deterioration caused by light when a printed image is displayed, and showing an excellent stability with time of the printed image, and a method for producing such recording medium for ink.

The invention also provides a recording medium for ink having at least one layer laminated on a substrate and including an ink receiving layer containing alumina hydrate as an outermost layer, in which a surface of the substrate at least on the side of the ink receiving layer is subjected to a cationizing treatment, further having an undercoat layer on the side of such cationizing treatment to obtain cations in a predetermined distribution, and having an outermost ink receiving layer laminated on said undercoat layer, and a producing method for such recording medium for ink.

8 Claims, 2 Drawing Sheets

U.S. PATENT DOCUMENTS

| | | | | |
|---|---|---|---|---|
| 4,723,129 | A | 2/1988 | Endo et al. | 346/1.1 |
| 4,740,796 | A | 4/1988 | Endo et al. | 346/1.1 |
| 5,523,149 | A | 6/1996 | Kijimuta et al. | 428/307.3 |
| 5,635,291 | A | 6/1997 | Yoshino et al. | 428/304.4 |
| 5,670,242 | A | 9/1997 | Asano et al. | 428/212 |
| 5,952,051 | A | 9/1999 | Asano et al. | 427/362 |
| 5,955,185 | A | 9/1999 | Yoshino et al. | 428/304.4 |
| 5,965,252 | A | 10/1999 | Santo et al. | 428/329 |
| 6,203,899 | B1 | 3/2001 | Hirose et al. | 428/341 |
| 6,436,514 | B1 | 8/2002 | Ishiyama et al. | 428/195 |
| 6,511,736 | B1 | 1/2003 | Asano et al. | 428/195 |
| 7,255,901 | B2 * | 8/2007 | Yamaguchi et al. | 428/32.3 |
| 2001/0016249 | A1 | 8/2001 | Kitamura et al. | 428/195 |
| 2001/0055055 | A1 | 12/2001 | Eguchi et al. | 347/105 |
| 2003/0152721 | A1 | 8/2003 | Barcock et al. | 428/32.35 |
| 2004/0058098 | A1 | 3/2004 | Kondo et al. | 428/32.1 |

FOREIGN PATENT DOCUMENTS

| | | | |
|---|---|---|---|
| EP | 0 818 322 | A1 | 1/1998 |
| EP | 1 048 479 | A2 | 11/2000 |
| EP | 1 080 938 | A2 | 3/2001 |
| EP | 1 226 959 | A2 | 7/2002 |
| JP | 57-44605 | B2 | 9/1982 |
| JP | 7-76161 | A | 3/1995 |
| JP | 7-89220 | A | 4/1995 |
| JP | 7-232473 | A | 9/1995 |
| JP | 8-132731 | A | 5/1996 |
| JP | 8-230311 | A | 9/1996 |
| JP | 8-324100 | A | 12/1996 |
| JP | 8-338000 | A | 12/1996 |
| JP | 9-66663 | A | 3/1997 |
| JP | 9-66664 | A | 3/1997 |
| JP | 9-76628 | A | 3/1997 |
| JP | 10-016377 | | 1/1998 |
| JP | 10-081065 | | 3/1998 |
| JP | 11-105414 | A | 4/1999 |
| JP | 11-291621 | A | 10/1999 |
| JP | 2000-198268 | A | 7/2000 |
| JP | 2001-10220 | A | 1/2001 |
| JP | 2001-138628 | A | 5/2001 |
| JP | 3204749 | B2 | 9/2001 |
| JP | 2001-334747 | | 12/2001 |
| JP | 2001-341412 | A | 12/2001 |
| JP | 2002-225423 | A | 8/2002 |
| JP | 2002-307823 | A | 10/2002 |
| JP | 2002-321445 | A | 11/2002 |
| JP | 2003-94800 | A | 4/2003 |
| JP | 2003-165269 | A | 6/2003 |
| JP | 2003-191633 | A | 7/2003 |
| JP | 2003-251915 | | 9/2003 |

* cited by examiner

RECORDING MEDIUM FOR INK AND METHOD FOR PRODUCING THE SAME

This application is a division of application Ser. No. 10/678,143 filed Oct. 6, 2003, which is a continuation of International Application No. PCT/JP03/07000 filed on Jun. 3, 2003, which claims the benefit of Japanese Patent Application No. 162910/2002, filed Jun. 4, 2002.

BACKGROUND OF THE INVENTION

1. Field of the Invention

The present invention relates to a recording medium for ink, particularly a recording medium for ink suitable for ink jet recording, and a method for producing a recording medium for ink. More specifically, the present invention relates to a novel recording medium which is improved in a displacement of a coloring agent in the recording medium, generated in an image after the coloring agent contained in ink is received as a fixed image, a producing method therefor, and a substrate (base paper) on which an ink receiving layer is to be formed, and is to provide a recording medium for ink capable of suppressing an image deterioration resulting from a coloring agent (dye) displacement which tends to be caused particularly during a storage in a high humidity environment or an image deterioration caused by light when a printed image is displayed thereby exhibiting an excellent stability with time of the printed image, and a method for producing a recording medium for ink.

2. Related Background Art

Recently, as a recording medium for ink having a high ink absorbability and capable of providing a high quality image, there is being commercialized a recording medium for ink having an ink receiving layer which employs an alumina hydrate as an inorganic pigment. The recording medium for ink having the ink receiving layer employing such alumina hydrate, because of a positive charge of the alumina hydrate, shows a satisfactory fixation of the dye constituting the coloring agent in the ink and a satisfactory transparency, thereby providing advantages in comparison with the prior art recording media for ink such as a higher print density, an improved color development in the image, a higher surface glossiness and an image of photographic gradation.

Also because of the spreading of digital cameras, the recording medium for ink for recording the image information thereof is required to have a photograph-like glossy feeling in addition to a high image quality, in order to obtain an image close to a silver halide photograph. In the recording medium for ink having an ink receiving layer employing an alumina hydrate as disclosed in the foregoing proposal, in case the substrate is a film, the ink receiving layer is formed by applying a coating liquid containing the alumina hydrate to obtain an image having a photographic glossiness. On the other hand, in case the substrate is a fiber-based one namely paper, the photographic glossiness cannot be obtained even by employing a coating liquid containing alumina hydrate for forming the ink receiving layer, and a super calendering or a cast coating is employed for providing the ink receiving layer with a gloss. In such case, a glossy image closer to the silver halide photograph can be obtained by a recording medium for ink processed by the cast process.

Such ink receiving layer containing alumina hydrate has a coloring agent fixing function because alumina functions as a cationic reactive material for an anionic dye, and, in order to further improve such function, Japanese Patent Application Laid-open Nos. 9-66663 (reference 1) and 2001-341412 (reference 2) disclose inventions for enhancing such function.

The reference 1 describes application of a cationic treatment also on an outermost layer, and the reference 2 describes application of a cationic treatment on the fibers of the substrate. Also Japanese Patent Application Laid-open No. 8-230311 (reference 3) discloses a technology of causing a cationic surfactant to penetrate into an outermost layer.

On the other hand, against so-called rear penetration phenomenon caused by penetration of the recorded ink through the substrate and a re-displacement of the coloring agent, reaching the substrate, by deposition of water, Japanese Patent No. 3204749 (reference 4) discloses an invention of providing a layer containing a cationic polymer resin between the substrate and the ink receiving layer. According to this invention, after coating and drying of a coating liquid in which a water-soluble cationic polymer resin is dissolved in water, an ink receiving layer is formed with a coating liquid containing a pigment such as silica and a binder. This invention provides an intermediate layer containing a cationic polymer in order to intercept the coloring agent that can reach the substrate. Similarly Japanese Patent Application Laid-open No. 11-105414 (reference 5) describes a recording medium having an undercoat layer between the substrate and the ink receiving layer, in which the undercoat layer contains at least one water-soluble cationic resin.

Also, the recording material for recording the aforementioned image information is being required to have a photograph-like glossiness in order to obtain an image close to a silver halide photograph. In order to meet such requirement, it is already known that a recording medium of a high glossiness can be obtained by employing a cast process to a recording medium having an ink receiving layer employing alumina hydrate and polyvinyl alcohol as binders. In particular, Japanese Patent Application Laid-open No. 2001-138628 (reference 6), for providing a high gloss for ink jet recording, discloses an invention of employing re-swelling as a technology for improving the cast process.

Formation of an ink receiving layer employing alumina hydrate and polyvinyl alcohol as binders is already known, but a viscosity increase with time in the coating liquid containing alumina hydrate and polyvinyl alcohol is an important factor in the management. This is partly recognized in Japanese Patent Application Laid-open No. 7-76161 (reference 7). The reference 2 proposes, in order to solve fine cracks generated in drying the above-mentioned coating liquid, an alumina sol coating liquid containing alumina hydrate, polyvinyl alcohol and a predetermined amount of boric acid or a borate salt and a resinous film coated with such liquid (however, this reference only considers the coating liquid directly coated on the resinous film and only discloses coating of the liquid in one point where the ink receiving layer is 23 g/m$^2$). On the other hand, Japanese Patent Application Laid-open No. 11-291621 (reference 8) cites the reference 2 and points out the difficulty of stable coating with the coating liquid disclosed in the reference 2 (references 7, 8 being by the same applicant). The reference 8 is based on a technical concept denying the improvement in the coating liquid and discloses a substrate paper which is obtained by sizing and drying a base paper principally formed by paper and prior to the coating process. More specifically, this invention prepares in advance a base paper by drying boric acid or the like of 0.5 to 1.5 g/m$^2$ and a paper surface treating agent (surface reinforcing agent or surface sizing agent) with a size pressing. In an example in the reference 8, after the preparation of such base paper, a coating liquid constituted of boemite and polyvinyl alcohol and not containing a crosslinking agent, and the prepared coating liquid is applied on the aforementioned base paper. The size pressing means, generally for improving water resistance, surface smoothness, printability etc. of the base paper, to slightly coat or impregnate the surface of the base paper with the sizing agent and then to dry for example with drum dryer. Therefore, the aforementioned references 7, 8 recognize the viscosity increase in the coating liquid, which is a drawback in the prior technology, but the reference 7 merely tries to find a solution in the composition of the coating liquid while the reference 8 merely tries to find a solution in the base paper.

SUMMARY OF THE INVENTION

A cationic substance for an ink receiving layer, recognized in the prior technology, is mixed in a coating liquid (containing a pigment such as alumina hydrate and a binder) for forming the ink receiving layer, but cannot be mixed in an amount sufficient for fixing the coloring agent as it generates gelation of the coating liquid. In particular alumina hydrate, in case employed as a pigment, can be used only in a small amount as it causes an evident problem. On the other hand, in case the cationic substance is provided or impregnated in an outermost layer of the ink receiving layer, the coloring agent is localized at the surface to increase the image density, but the coloring agent overflows in the lateral direction (hereinafter called lateral diffusion) instead of penetration in the direction of thickness of the recording medium, thereby deteriorating the sharpness of the image. Also because of the localization of the coloring agent at the surface of the recording medium, it is not effective for light fastness and moisture resistance. These tendencies become more conspicuous as the amount of the ink deposited on the recording medium increases. Also under a high humidity environment, the fixed coloring agent, being soluble in water, may cause a lateral diffusion in the recording medium, thereby causing a substantial deterioration of the image. Also between adjacent images of different colors, the lateral diffusion forms another color whereby the image may become different from the proper image.

A principal object of the present invention is to provide a recording medium capable of preventing the deterioration of the image caused by the aforementioned lateral diffusion, by taking the re-displacement or the fixing mechanism of the coloring agent into consideration to deal with the response of the cationic substance to the coloring agent which has not been solvable in the prior technology. It is also a principal object of the present invention to provide a producing method capable of securely realizing such characteristics.

Another object of the present invention is to provide an invention capable of preventing the aforementioned lateral diffusion, by defining the construction of the substrate itself on which the ink receiving layer is to be formed. Still another object of the present invention is to provide a recording medium satisfying a correlation with the ink receiving layer to more fully exploiting the characteristics of the ink receiving layer, thereby preventing the rear penetration and forming and maintaining a sharp image. Another object of the present invention is to provide a recording medium for ink for ink jet recording, having an ink absorbing ability capable of absorbing a large amount of ink at a high speed, an excellent color developing property and a high producibility and capable of forming a high quality image with suppressed crack formation in the ink receiving layer, and a method for producing the recording medium for ink. Also another object of the present invention is to provide a recording medium for ink for ink jet recording, capable of suppressing an image deterioration caused by a dye displacement which tends to appear particularly in an image storage under a high humidity condition, and an image deterioration caused by light when a printed image is displayed, and showing an excellent stability with time of the printed image, and a method for producing the recording medium for ink.

As a result of intensive investigations for meeting the aforementioned objects, the present inventors have found that the cationic substance is desirably not mixed in the coating liquid constituting each layer such as the ink receiving layer but is diffused by penetration from a lower surface, that the ink receiving layer exhibit its characteristics preferably without addition of such cationic substance, and that the lateral diffusion phenomenon of the coloring agent in the ink takes place at an interface between the layers. More specifically, the cationic substance is made to gradually increase for the permeating liquid containing the coloring agent (preferably the cationic substance is made absent at the start of such increase thereby facilitating reception of the moving coloring agent at a lower side and, at the interface of two layers, the permeation toward the lower layer is accelerated so as to resist the lateral diffusion), whereby the permeating liquid can be made to proceed relatively in the direction of thickness of the recording medium without much lateral diffusion even in the case where association or aggregation of the coloring agent takes place. As a result it is rendered possible to secure the sharpness of the image and to significantly reduce a bleeding of the image caused by the lateral diffusion.

The present invention is based on this fact and provides, as a first invention, a recording medium for ink having an ink receiving portion for receiving an ink and holding a coloring agent of the ink, wherein an increasing region, in which a reactive substance capable of reacting with the coloring agent to hold the coloring agent is present with such a distribution as to increase in the direction of depth in the ink receiving portion, is provided in a position separated from an ink recording surface of the recording medium for ink. According to this first invention, a cationic substance having the above-mentioned distribution is capable of suppressing an image deterioration which results from displacement of the dye absorbed in the ink receiving layer and which tends to appear under a high humidity environment.

In addition to the first invention, there are preferred conditions that the ink receiving portion includes an interface which is a boundary of two different layers and the above-mentioned increasing region does not include the interface of such two different layers, that a decreasing region, in which the reactive substance is present in such a distribution as to decrease in the direction of depth of the ink receiving portion, is provided in a position more distant from the side of the ink recording surface than the above-mentioned increasing region, that the ink receiving portion includes an alumina hydrate layer at the side of the above-mentioned ink depositing surface and the increasing region is not present in the alumina hydrate layer, that the ink receiving portion includes an alumina hydrate layer at the side of the ink depositing surface and the distribution of the maximum concentration in the increasing region is not present in the alumina hydrate layer, or that the ink receiving portion includes an interface which is a boundary of two different layers and the increasing region is formed starting from such interface not containing the reactive substance.

Also the substrate of the present invention is a substrate, for a recording medium for ink, on which there is formed an ink receiving layer containing at least a pigment for holding the coloring agent of the ink and a binder for such pigment, including an increasing region in which a reactive substance capable of reacting with the coloring agent thereby holding the coloring agent is present in such a distribution as to increase in the direction of depth as viewed from a surface on which the ink receiving layer is to be formed. Thus the aforementioned problems can be solved by the characteristics of the substrate, even excluding the formation of the ink receiving layer. Because of the aforementioned reasons, the substrate of the present invention preferably does not include the reactive substance on the surface on which the ink receiving layer is to be formed.

Still other features and effects relating to the relationship with the ink receiving layer of the present invention will be understood from the following description.

DETAILED DESCRIPTION OF THE PREFERRED EMBODIMENTS

In the following, the present invention will be clarified in detail by a preferred embodiment. The recording medium of this embodiment is featured in that one or more layers are provided on a substrate, that an ink receiving layer containing alumina hydrate is provided on the outermost layer thereof, that a surface of the substrate on the side of the ink receiving layer is subjected to a cationizing treatment and that an undercoat layer laminated with the ink receiving layer has a distribution of the cation as in an increasing region A shown in FIG. 1.

Figure 1:
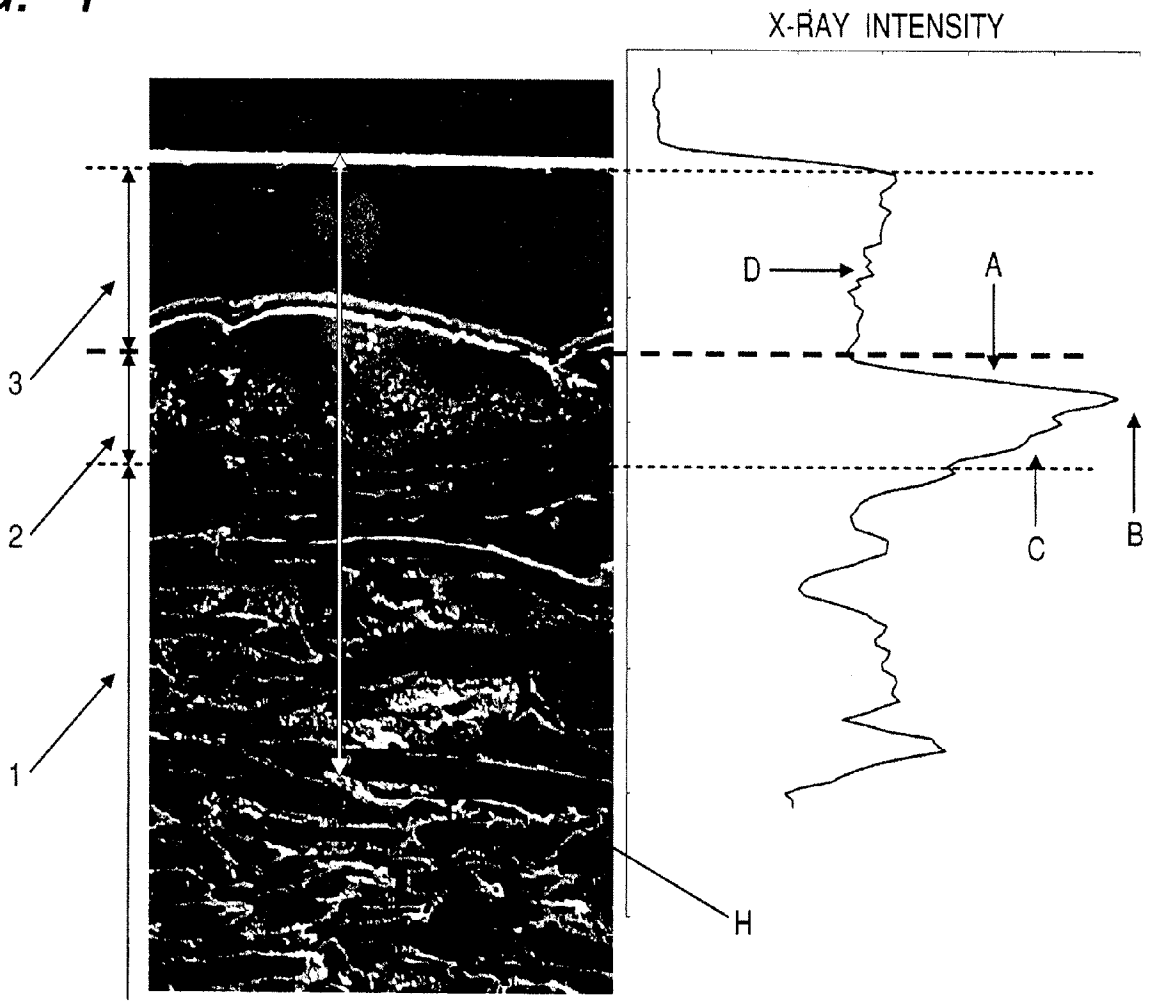
FIG. 1 is a view showing a cross section of a recording medium for ink of the present invention and showing a relative distribution of a cation ($N^+$) in corresponding positions.

FIG. 1 is a view showing a cross section of a recording medium for ink of the present invention and showing a relative distribution of a cation ($N^+$) in corresponding positions, and indicates the relative proportion of cations obtained by measuring a magnified cross section of the recording medium of an embodiment 1 to be explained later. A numeral 1 indicates a paper-based substrate constituted of a base paper, and a water-soluble cation treated surface is formed on a surface thereof. A numeral 2 indicates an undercoat layer, formed by applying a coating liquid containing a pigment and a binder on the above-mentioned cation treated surface whereby cations diffuse from the lower surface. A numeral 3 indicates an ink receiving layer, formed by applying a coating liquid for the ink receiving layer on a surface, provided with anions, of the undercoat layer 2. In the ink receiving layer 3, cations of the aforementioned cationic treatment are not present as indicated by D (chart showing irregularities because of noises in measurement). On the other hand, the undercoat layer 2 includes a region A in which the cations gradually increase in the direction of thickness from the interface with the ink receiving layer 3 in which the cations of the aforementioned cationic treatment are not present, a maximum portion B and a region C in which the cations gradually decrease from the maximum portion in the direction of thickness. "H" schematically indicates the range of the ink receiving layer of the present invention.

In the following there will be explained the substrate, the ink receiving layer and the undercoat layer constituting the recording medium for ink of the present invention, and producing methods therefor.

A preferred example of the substrate employed in the present invention can be a substrate capable of evaporating water or a solvent component from the rear surface of the substrate at the drying of the ink receiving layer, executed in a cast step for forming a glossy surface on the recording medium for ink, and there is particularly preferred a fibrous substrate, namely paper. As such paper, there can be employed a base paper prepared by employing pulp, which can be wood pulp for example chemical pulp such as LBKP or NBKP, mechanical pulp such as GP, PGW, RMP, TMP, CTMP, CMP or CGP, used paper pulp such as DIP, or non-wood pulp such as kenaf, bagasse or cotton and an already known pigment as main components and mixing at least one of the various additives such as a binder, a sizing agent, a fixing agent, an yield improving agent, a cationizing agent, a paper strength increasing agent and produced with various apparatus such as a Fourdrinier paper machine, a cylinder paper machine or a twin wire paper machine, or a base paper prepared by forming, on the aforementioned base paper, with a size press or an anchor coat layer with starch, polyvinyl alcohol etc., or a coated paper such as art paper, coated paper or cast coat paper prepared by forming a coated layer on such base paper.

The recording medium for ink of the present invention is featured in that at least a side of the ink receiving layer of the substrate such as the base paper or the coated paper mentioned above is subjected to a cationizing treatment. Therefore, in producing the recording medium for ink of the present invention, it is necessary to execute the cationizing treatment on the substrate prior to the formation of the undercoat layer to be laminated with the ink receiving layer. The cationizing treatment is preferably executed with a processing liquid containing at least one of the cationic substances listed in the following. Prior to the cationizing treatment of the substrate, if necessary, the substrate may be subjected to side adjustment with a sizing agent, or there may be provided another layer such as an adhesion promoting layer. Also there may be executed a corona treatment in order to improve the adhesion between the cationizing substance for cationizing the substrate and the substrate.

The cationic substance to be employed in the present invention is not particularly limited as long as it includes a cationic portion within a molecule. For example there can be employed a cationic surfactant of the quaternary ammonium salt type such as monoalkylammonium chloride, dialkylammonium chloride, tetramethylammonium chloride, trimethylphenylammonium chloride, or ethylene-oxide-added ammonium chloride, or a cationic surfactant of the amine salt type, or an amphoteric surfactant such as alkylbetain, imidazolium betain or alanine which includes a cationic portion.

There can also be employed a polymer or an oligomer having a cationic property. Examples of the polymer or the oligomer having cationic property include a cation-modified product of polyacrylamide, a copolymer of acrylamide and a cationic monomer, polyethylenimine, a polyamide-epichlorhydrine resin, polyaminepolyamide epichlorhydrine, polyvinylpyridinium halide, a dimethyldiallylammonium chloride polymer, polyamidamine, polyepoxyamine, dicyandiamide-formalin condensate, or various polyamine resins such as polyallylamine, polyaminesulfon, or polyvinylamine. There can also be employed a homopolymer of a vinylpyrrolidone monomer or a copolymer thereof with another ordinary monomer, a homopolymer of vinyloxazolidone monomer or a copolymer thereof with another ordinary monomer, a homopolymer of vinylimidazole monomer or a copolymer thereof with another ordinary monomer. The ordinary monomer mentioned above can be, for example, methacrylate, acrylate, acrylonitrile, vinylether, vinyl acetate, ethylene or styrene.

Among these cationic substances, there is particularly preferred an alkyl (meth)acrylate quaternary ammonium salt having a benzyl group, or a cationic resin such as a polymer or a copolymer including an alkyl (meth)acrylamide quaternary ammonium salt as a skeleton. In case of employing an anion (borate ion) for forming a salt with a metal ion as in the following example, such cationic polymer or cationic organic substance is preferred for obtaining the aforementioned cation distribution.

Although not particularly restricted, an amount of the cationic substance employed in the cationizing treatment is preferably 0.1 to 5 g/m$^2$ in terms of solid, more preferably 0.5 to 3 g/m$^2$. In a preferred embodiment of the recording medium for ink of the present invention, a glossy surface is provided on at least one surface there of in order to enable formation of a photographic image, and, in such case, an amount of the cationic substance, employed for the cationizing treatment of the substrate, exceeding 5 g/m$^2$ may deteriorate the surface property or the glossiness of the glossy surface. More specifically, the formation of a glossy surface is executed for example by drying a material forming the ink receiving layer and constituting the outermost layer of the recording medium for ink in contact, while in a wet state, with a heated mirror surface, and, in such operation, a large amount of the cationic substance employed for the cationizing treatment provides a thick and dense treated layer, whereby the surface property or the glossiness of the glossy surface of the recording medium for ink may be deteriorated. Also an amount exceeding 3 g/m$^2$ shows a slight loss of the surface property and the glossiness in comparison with a case of 0.5 to 3 g/m$^2$.

The cationizing treatment of the surface of the substrate can be achieved by an already known method, for example by a coating with a coating apparatus such as a roll coater, a blade coater, a gate roll coater, a bar coater, a size press, a curtain coater, an air knife coater, a spray coater or a (micro)gravure coater. In the cationizing treatment of the substrate of the present invention, it is particularly preferred to employ a blade coater, a size press or a (micro)gravure coater in consideration of the coating productivity.

The cationizing treatment of the surface of the substrate is completed by drying thereafter with a hot air oven, or a heated drum. Also if necessary, in order to improve the smoothness or the surface strength of the cationized surface of the substrate, a calendering or super calendering process may be applied.

The recording medium for ink of the present invention is formed by applying a cationizing treatment on the surface of the substrate as explained in the foregoing, and forming, on such substrate, at least an undercoat layer and an outermost ink receiving layer laminated thereon. In the following there will be given an explanation on the undercoat layer.

The substrate, which is composed of a base paper or a coated paper as explained in the foregoing and of which surface is subjected to the cationizing treatment, may be directly provided with an undercoat layer, but there may also be applied a calendering process for surface smoothing or thickness adjustment of the substrate. Also in consideration of evaporation of water or solvent component from the rear surface of the substrate and of ease of coating of the undercoat layer, it is preferred to employ a substrate having an air permeability of 20 to 500 seconds determined by JISP8117. In case the air permeability of the substrate is less than the above-mentioned range, namely in case of a substrate of a lower density, printing on a recording medium for ink utilizing such substrate may result in swelling of the substrate due to ink absorption, thereby causing an ondulation and being unable to obtain a quality feeling comparable to that of a silver halide photograph. On the other hand, in a substrate with the air permeability exceeding the above-mentioned range, a satisfactorily glossy surface may not be obtained because water or solvent component cannot easily evaporate from the rear surface of the substrate at the casting process.

In consideration of the above-mentioned reasons and prevention of a loss in the gloss obtained by the cast process, it is advantageous to employ, in the present invention, a substrate having a Stöckigt sizing degree (JISP8122) within a range of 20 to 300 seconds and a Bekk smoothness (JISP8119) within a range of 10 to 60 seconds. Also in order to obtain a recording medium comparable in quality feeling to the silver halide photograph and having a stiffness at an A4 size or larger, it is preferred to employ a substrate of a basis weight of 140 to 200 g/m$^2$ and a Gurley stiffness (JISP8125, machine direction) of 3 to 15 mN. In producing the recording medium for ink of the present invention, it is preferred to employ a substrate of which the basis weight, thickness, ash content, internal size amount and surface size amount are suitably selected and adjusted so that the characteristics of the substrate remain within the above-mentioned ranges.

The recording medium for ink of the present invention, in which at least a substrate surface on the side of the ink receiving layer is subjected to a cationizing treatment and which includes at least an undercoat layer and an outermost ink receiving layer laminated on such undercoat layer, on the side of the ink receiving layer, has an ink absorbing ability capable of absorbing a large amount of ink at a high speed, also shows an excellent color forming ability and is capable of forming a high quality image with suppressed crack formation in the ink receiving layer. Particularly it can suppress generation of an image deterioration due to a dye displacement, which may take place in case the image is maintained under a high humidity environment, and generation of an image deterioration by light in case the image is displayed, thereby providing excellent stability with time of the printed image.

According to the investigations of the present inventors, among the aforementioned effects, the effects against the generation of image deterioration under the high humidity environment and against the generation of image deterioration by light can be particularly securely obtained by forming an undercoat layer between the ink receiving layer and the substrate subjected to the cationizing treatment. In the recording medium for ink of the aforementioned construction, the cationic substance present under the undercoat layer suppresses the generation of the image deterioration resulting from a displacement of the dye absorbed in the ink receiving layer.

At the time when the cationizing treatment of the surface of the substrate 1 and lamination of the undercoat layer 2 thereon are carried out, the cationic substance is localized in the vicinity of the surface of the substrate 1 and is scarcely present on the outermost surface of the undercoat layer 2. In such case, the cationic substance employed in the cationizing treatment can be thereafter diffused in the undercoat layer to form the aforementioned distribution of the cationic substance, in the course of coating and drying of the undercoat layer, coating and drying of the outermost ink receiving layer, or formation of the glossy surface by drying the outermost ink receiving layer in a wet state or a re-wetted state in contact with the heated mirror surface. In this manner it is rendered possible to effectively suppress the dye displacement in the ink receiving layer, which tends to appear in a high humidity environment, and generation of an image deterioration resulting therefrom.

On the other hand, in order to suppress the generation of the image deterioration resulting from the dye displacement in the ink receiving layer under a high humidity environment, it is also conceivable to mix the cationic substance in a coating liquid for forming the outermost ink receiving layer, but the investigation of the present inventors indicates that the amount of addition to alumina hydrate is quite limited and cannot effectively suppress the generation of the image deterioration resulting from the dye displacement under the high humidity environment. Also, depending upon the amount of addition, the coating liquid may gell or coagulate in the course of preparation thereof, whereby the formation of the ink receiving layer becomes impossible. Also, though the formation of the ink receiving layer is possible in case the coating liquid does not gell nor coagulate, but the effect for suppressing the image deterioration by light when the image is displayed becomes evidently inferior to that in the construction of the present invention. The present inventors estimate its cause because the cationic substance is selectively present rich in the ink receiving layer constituting the outermost surface of the recording medium for ink in the above-described case, in contrast to the aforementioned construction of the cationic substance. It is also conceivable, in order to obtain an effect similar to that of the present invention, to mix the cationic substance in a coating liquid for forming the undercoat layer. However in such case, like the above-mentioned case, the alumina hydrate and the cationic substrate show a very high possibility of gelation or aggregation, whereby, depending on the amount of the cationic substance contained in the undercoat layer, there may be caused a crack formation in the outermost ink receiving layer or a loss in the surface gloss.

In the following there will be explained material for forming the undercoat layer constituting the recording medium for ink of the present invention. The undercoat layer can be formed by a coating liquid including a pigment and a binder, but is preferably provided with an ink receiving property. For the pigment, there can be employed at least one selected from inorganic pigments such as light calcium carbonate, heavy calcium carbonate, magnesium carbonate, caolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, alumina, alumina hydrate, aluminum hydroxide, lithopone, zeolite, and hydrogenated halocite, and organic pigments such as styrenic plastic pigments, acrylic plastic pigments, polyethylene particles, microcapsule particles, urea resin particles and melamine resin particles.

For the binder, there can be employed, without any particular restriction, any material capable of forming a film by binding the above-mentioned pigment and not hindering the effects of the present invention. For example there can be employed a starch derivative such as oxidized starch, etherized starch, or phosphate esterized starch; a cellulose derivative such as carboxymethyl cellulose, or hydroxyethyl cellulose; casein, gelatin, soybean protein, polyvinyl alcohol or a derivative thereof; a conjugate polymer latex such as polyvinylpyrrolidone, a maleic anhydride resin, a styrene-butadiene copolymer, or a methyl methacrylate-butadiene copolymer; an acrylic polymer latex such as of a polymer or a copolymer of an acrylate ester or a methacrylate ester; a vinylic polymer latex such as an ethylene-vinyl acetate copolymer; a functional group-modified polymer latex for example of the foregoing polymers modified with a monomer containing a functional group such as a carboxyl group; foregoing polymers which are rendered cationic with a cationic group, rendered surfacially cationic with a cationic surfactant, polymerized in the presence of a cationic polyvinyl alcohol to obtain a distribution of such polyvinyl alcohol on the polymer surface, or polymerized in a suspension liquid of cationic colloid particles to obtain a distribution of such particles on the polymer surface; an aqueous binder of a thermosettable resin such as melamin resin or urea resin; a polymer or copolymer synthetic resin of an acrylate ester or a methacrylate ester such as polymethyl methacrylate; or a synthetic resin binder such as polyurethane resin, unsaturated polyester resin, vinyl chloride-vinyl acetate copolymer, polyvinylbutyral, or alkyd resin. These binders may be used singly or in a combination of two or more kinds.

The undercoat layer can be easily formed by applying and drying a coating liquid, containing the pigment and the binder as explained above, on the surface of the substrate. The undercoat layer is formed at least on a surface of the substrate on the side of the ink receiving layer, but it is also possible to form the undercoat layer on the rear surface, thereby providing the undercoat layers on both sides of the substrate. In consideration of stability of environmental curling of the recording medium for ink, the undercoat layer is preferably formed on both sides of the substrate. In order to sufficiently cover surfacial fibers, such as cellulose pulp constituting the substrate, the undercoat layer preferably has a dry coating amount of 10 g/m$^2$ or higher, more preferably 15 g/m$^2$ or higher. A dry coating amount less 10 g/m$^2$ is insufficient for completely covering the surfacial fibers such as cellulose pulp of the substrate, whereby the glossiness may be affected.

Also the amount of the binder in the coating liquid for forming the undercoat layer is preferably 5 to 50 mass % with respect to the pigment. A binder amount less than the above-mentioned range tends to generate cracks in the undercoat layer and to result in an insufficient mechanical strength of the undercoat layer, thereby causing powder falling. Also an amount exceeding the above-mentioned range tends to deteriorate the absorbability for the solvent of the ink and the evaporation of water etc. (vapor movement to the rear surface of the substrate) in the casting process. In the present invention, a calendering process may be executed if necessary after the formation of the undercoat layer, thereby enabling to adjust the thickness of the substrate/undercoat layer.

In consideration of evaporation of water or solvent component from the rear surface of the substrate, also of a coating property (wetting property) in first and second surface treatment steps to be explained later and of a coating property for the outermost ink receiving layer to be formed thereafter, it is preferred, for the recording medium for ink of the present invention, that the substrate having the undercoat layer on both sides has an air permeability of 1,500 to 5,000 seconds (JISP8117). There is also a desirable construction having a Stöckigt sizing degree of 100 to 400 seconds and a bekk smoothness of 100 to 500 seconds. These characteristics can be obtained by suitably controlling the composition and the dry coating amount of the undercoat layer, and presence or absence of calendering process. Also in order to obtain a recording medium comparable in quality feeling to the silver halide photograph and having a stiffness at an A4 size or larger, it is preferred to adjust the substrate and the undercoat layer so as to have a basis weight of 160 to 230 g/m$^2$ and a Gurley stiffness (JISP8125, machine direction) of 7 to 15 mN.

In the following there will be explained a method of forming the ink receiving layer laminated on the undercoat layer explained above. In such case, it is preferred to prepare the recording medium for ink by applying, to the undercoat layer, a surface treatment constituted of two steps explained in the following, and then forming the ink receiving layer. The surface treatment to be executed in such case is preferably constituted by a first surface treatment step of applying a coating liquid containing one or more compounds selected from the group of boric acid and borate salts on the undercoat layer and drying such undercoat layer, and a second surface treatment step of applying, on the undercoat layer after the first surface treatment step, a coating liquid containing one of more compounds selected from the group of boric acid and borate salts. It is further preferred that the ink receiving layer is formed while the coating liquid coated in the second surface treatment step is still in a wet state.

The coating liquid, containing one of more compounds selected from the group of boric acid and borate salts and to be employed in the surface treatment of the undercoat layer, most preferably contains borax (sodium tetraborate) in consideration of the ability for suppressing crack formation.

For preparing the recording medium for ink of the present invention, the outermost ink receiving layer is formed after the aforementioned surface treatment is applied to the undercoat layer. In the following, there will be given an explanation on the ink receiving layer of the present invention. The ink receiving layer can be formed in general by applying a coating liquid including a pigment as explained in the following and a binder. There can be employed an inorganic pigment such as a light calcium carbonate, heavy calcium carbonate, magnesium carbonate, caolin, aluminum silicate, diatomaceous earth, calcium silicate, magnesium silicate, synthetic amorphous silica, colloidal silica, alumina, alumina hydrate or magnesium hydroxide; or an organic pigment such as styrenic plastic pigments, acrylic plastic pigments, polyethylene particles, microcapsule particles, urea resin particles or melamine resin particles. In the recording medium for ink of the present invention, as a main component of the ink receiving layer, there is employed alumina hydrate which is particularly preferred in the dye fixability, transparency, print density, color forming property and glossiness, among the foregoing substances. In the coating liquid for forming the ink receiving layer, the content of alumina hydrate is preferably from 60 to 100 mass % with respect to the inorganic pigment contained in the coating liquid.

The present invention also provides a further preferred embodiment in the relation between the formed state of the ink receiving layer and the aforementioned cation distribution. The aforementioned cation distribution can be formed by diffusing a water-soluble cationic resin not in the ink receiving layer but in the undercoating layer lying thereunder from a lower surface thereof into the interior thereof, and by diffusing an anionic substance from an upper surface thereof constituting an interface with the ink receiving layer, whereby obtained is a distribution in which the cationic substance gradually increases in the direction of depth (cf. FIG. 1). In the following there will be explained a preferred embodiment in which the anionic substance is also used as a crosslinking agent for the binder. The mechanism of formation of the ink receiving layer has been investigated from various view points, in order to achieve fundamental technical analyses on the pigment and the binder contained in the coating liquid and the solvent employed for dissolving the binder. As a result, the present inventors have obtained a first knowledge that it is important to generate "a mechanism in which the binder, behaving as a dispersant for the pigment in the coating liquid, is positioned around the pigment which starts to aggregate at the drying of the coating liquid thereby binding such pigment" in the coating liquid, while maintaining a mixed state in the coating liquid as long as possible. There has also been obtained a second knowledge that it is important to obtain a uniform distribution of the binder in the ink receiving layer, since, also in the recording medium itself, a fluctuation in the distribution of the binder may form an area of a lowered density by an excessive ink absorption or an area of reduced ink absorbability to cause a deterioration of the image quality by ink overflowing.

Technical aspects for meeting these knowledges include "a first target of preventing the transfer of the binder together with the solvent in a large amount from the coating liquid to a surface to be coated (member to be coated), with the coating liquid, and securely crosslinking the binder in the vicinity of the interface between the coated surface and the coating liquid", then "a second target of utilizing the characteristics of the pigment, not only in forming the crosslinked state of the binder but also in causing an aggregation or a viscosity increase of the pigment and forming a rational pore distribution", also "a third target of providing a preferred form for forming the surface to be coated" and "a fourth target of obtaining a recording medium prepared by the producing method attaining these targets and improving the recording characteristics obtained by the configurational features of the recording medium". More specifically, the present invention also has a technical target that "polyvinyl alcohol soluble in water (preferably purified water for preventing impurity to alumina) functions principally as a solute in water of the coating liquid for forming the ink receiving layer but does not diffuse together with water in the coated layer and performs a rapid functional change from the solute to a binder".

An embodiment relating to the ink receiving layer is based on a correlation between the structure of the ink receiving layer on the ink recording surface side thereof and the interior thereof, and a layer region including a surface to be coated on which the ink receiving layer is formed, and representatively prevents the loss of the binder of the coating liquid into the side of the surface to be coated, utilizing a reaction rate or a reaction state at a liquid-liquid interface to achieve effective removal of the solvent present in the coating liquid, thereby attaining at least one of the aforementioned targets. In the embodiment relating to the ink receiving layer, there is used a term "layer region" involving a thickness, but a layer need not be formed in a complete form or may be formed as an area with a certain thickness.

In the aforementioned embodiment relating to the ink receiving layer, since it is preferred, at the aforementioned crosslinking reaction, to exclude the liquid component such as the solvent (water in case of PVA (preferably purified water in order to avoid impurity for alumina)) for dissolving the binder of the coating liquid, the recording medium preferably includes, as the substrate for supporting the ink receiving layer, a porous member (paper, pulp, porous layer etc.) in which the liquid component of the coating liquid can permeate. In addition, in order to improve the adhesion and the strength of the ink receiving layer to the substrate (anchoring effect), it is also preferred that the aforementioned wet surface is not a smooth surface but have recesses for the coating liquid and cause a crosslinking of the binder in such recesses. Further features of the embodiment relating to the ink receiving layer will be understood from the following description.

Figure 2:
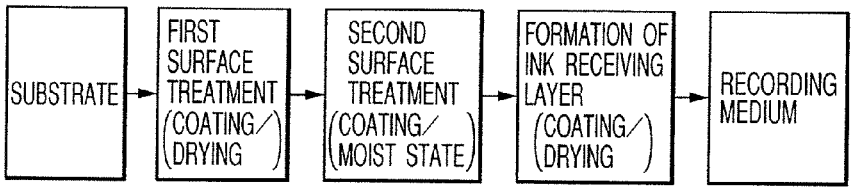
FIG. 2 is a flow chart showing a producing method, not including a cast step, for a recording medium in an embodiment relating to the ink receiving layer.
Figure 3:
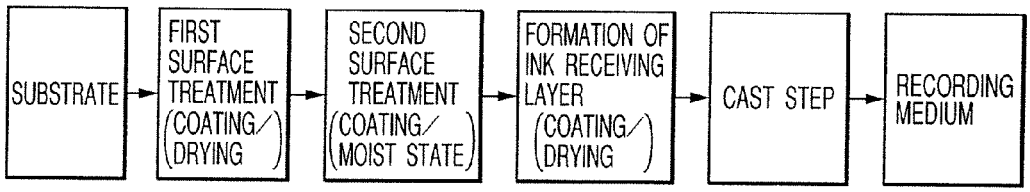
FIG. 3 is a flow chart showing a producing method, including a cast step, for a recording medium in an embodiment relating to the ink receiving layer.

In the following, the embodiment relating to the ink receiving layer will be clarified further by a preferred embodiment. A preferred producing method for the recording medium in the embodiment relating to the ink receiving layer is roughly classified into two forms shown in FIGS. 2 and 3. FIG. 2 shows a producing method including two surface treating steps and an step of forming the ink receiving layer. FIG. 3 shows a producing method for the recording medium, further including a cast step for providing surface gloss.

Now there will be explained a preferred form of the producing method for the recording medium, in the embodiment relating to the ink receiving layer. The producing method of the embodiment relating to the ink receiving layer is capable of obtaining an appropriate aggregating function of the pigment and a binding function of the binder securely at the liquid-liquid interface while maintaining the state of the coating liquid at the liquid-liquid interface, and also of preventing the loss of the binder which should be present in the ink receiving layer, thereby stabilizing the characteristics and providing a satisfactory productivity. The recording medium of the embodiment relating to the ink receiving layer has a novel construction that is realized as a result of retention of the binder to be present in the ink receiving layer, wherein the ink receiving layer includes a first layer region in which the binder is made relatively uniform with the pigment, and a second layer region in which the binder is crosslinked by a first crosslinking agent so as to reach a larger crosslinking degree than in the first layer region, and the first layer region is positioned closer, than the second layer region, to the ink recording surface.

In the embodiment relating to the ink receiving layer, at the formation of the ink receiving layer and in the final construction, the binder constituting the ink receiving layer can be positioned appropriately with respect to the pigment, so that a uniform pore distribution can be obtained by the pigment and the binder provided by the coating liquid. At the same time, a substantial barrier layer region capable of preventing the loss of the binder from the coating liquid is formed by a reaction state of a high speed and a high probability at the liquid-liquid interface, so that the crosslinking degree itself can be made larger. In order to achieve effective removal of the solvent in the coating liquid, since it is preferred, at the aforementioned crosslinking reaction, to exclude the liquid component such as the solvent (water in case of PVA (preferably purified water in order to avoid impurity for alumina)) for dissolving the binder of the coating liquid, the recording medium preferably includes, as the substrate for supporting the ink receiving layer, a porous member (paper, pulp, porous layer etc.) in which the liquid component of the coating liquid can permeate.

The embodiment relating to the ink receiving layer causes the binder, behaving as a dispersant for the pigment in the coating liquid, to be positioned around the pigment which starts to aggregate after the coating thereby binding such pigment, while maintaining the mixing proportion of the pigment and the binder prior to the coating as long as possible, and representatively utilizes the liquid-liquid interface mentioned above. It is thus possible to solve the problem in the ink receiving layer of a partial density loss resulting from an excessive ink absorption and a partial image quality loss resulting from an insufficient ink absorption, caused by the fluctuation of the binder in the prior technology. In the embodiment relating to the ink receiving layer, it is possible to prevent the transfer of the binder together with the solvent in a large amount from the coating liquid to a surface to be coated (member to be coated) with the coating liquid and to securely crosslink the binder in the vicinity of the interface between the surface to be coated and the coating liquid. Also by utilizing the viscosity increasing property and the aggregating property (pH dependency in case of alumina hydrate) of the pigment, it is rendered possible not only to form a crosslinked state of the binder but also to obtain an aggregation or a viscosity increase of the pigment and to form a reasonable pore distribution, and, the surface treatment in stepwise manner as explained in the following allows to obtain a uniform and stable surface to be coated. More specifically, in the embodiment relating to the ink receiving layer, polyvinyl alcohol soluble in water (preferably purified water for preventing impurity to alumina) functions principally as a solute in water in the coating liquid for forming the ink receiving layer but does not diffuse together with water in the coated layer and performs a rapid functional change from the solute to a binder. Also the embodiment relating to the ink receiving layer can provide a recording medium which can rapidly absorb a large amount of ink at a high speed, as required in a photoprinter recording, also can be produced in stable manner even with an ink receiving layer of 30 g/m$^2$ or larger (amount after drying), can achieve a substantial control of the binder which functions also as a dispersant, and is excellent in ink absorbing property and color forming property, and also provide a producing method of a satisfactory productivity for the recording medium.

In a producing method of the embodiment relating to the ink receiving layer, the substrate is subjected to a first surface treatment and a second surface treatment stepwise. A coating liquid to be employed in the first surface treatment step preferably provides a dry coating amount of 0.05 to 2.0 g/m$^2$ in terms of solid borax. An amount less than the aforementioned range results in an excessively low viscosity of the coating liquid thereby leading to a frequent liquid flow, while an amount exceeding the aforementioned range tends to generate spot-shaped defects on the surface (cast surface) in the cast process whereby a uniform and satisfactory glossy surface may not be obtained. In the first surface treatment step, a coating liquid containing at least one selected from the group of boric acid and borate salts, for example a 5% aqueous solution of borax is applied on the undercoat layer, then dried and solidified. The coating liquid may further include a solvent such as alcohol for defoaming if necessary. The first surface treatment step, since a lower dry coating amount is preferred, can be executed at a considerably high coating and drying speed, for example as high as 50 to 200 meters per minute.

In a second surface treatment step, executed in succession to the first surface treatment step, a coating liquid containing at least one selected from a group of boric acid and borate salts, as in the first surface treatment step, is applied on the surface treated substrate already subjected to the first surface treatment step. In the second surface treatment step, different from the first surface treatment step, the coating liquid is not dried and solidified after the coating. More specifically, the substrate surface is formed into a moist state of a certain level (which may be a liquid state or a viscosity increased state), and a next coating liquid for forming the ink receiving layer is applied while such state is maintained. In this operation, there is secured a reaction state by the liquid-liquid interface in the embodiment relating to the ink receiving layer. At this interface, the coating liquid for the ink receiving layer shows a faster gelling speed or a faster crosslinking speed. On the other hand, in case a reaction at the liquid-liquid interface cannot be obtained, the binder diffuses into the substrate or in the pores on the solidified surface formed by the first surface treatment, whereby an amount or a position of the binder for binding the pigment may be changed.

The aforementioned stepwise surface treatments provide the following advantage. In the first surface treatment step applied to the substrate, since the coating liquid is dried, boric acid or borate salt (hereinafter collectively called borate salt etc.) is present as a solid on the substrate or in the undercoat layer (an upper part in the layer). Then, when the second surface treatment and the formation of the ink receiving layer are executed in this state, an aqueous solution of boric acid or a borate salt (hereinafter collectively called borate processing solution etc.) coated in the second surface treatment step principally provides an advantage that a liquid surface can be secured by the borate processing solution etc. it is therefore also ensured that the coating liquid for forming the ink receiving layer in the next step and the borate processing solution etc. are contacted and mixed in a liquid-liquid state.

On the other hand, in case the coating liquid for forming the ink receiving layer and the borate salt etc. in solid state are contacted, the borate salt etc. in solid state dissolve in the coating liquid for forming the ink receiving layer over a certain time, during which the binder permeates from the liquid into the substrate, thereby generating a quantitatively deficient area. At the same time, the coating liquid in a portion where the borate salt etc. are dissolved reaches a concentration considerably higher than in a surrounding area, thereby causing a rapid local gelation or crosslinking and a local viscosity increase of the coating liquid to generate a "coating unevenness" in the interior and on the surface, whereby the ink receiving layer becomes extremely inhomogeneous, mixedly including an unnecessary giant pigment aggregation (resulting from deficiency of binder) and a bound state with the binder.

The use of the surface treatments in two steps allows to form a moist state more stably with the borate processing solution etc., on the substrate on which the borate salt etc. are present in solid state. A rapid crosslinking reaction can be realized in a liquid-liquid contact interface on the undercoat layer of the above-mentioned state, while the solvent such as water in the coating liquid for forming the ink receiving layer can be separated from the binder and eliminated by the pores of the formed porous substance, whereby an ideal aggregation of the pigment and an appropriate binding by the binder can be formed in a homogeneous state. As a result, it is rendered possible to suppress crack generation resulting from a binder deficiency at the manufacture, and to form a thick ink receiving layer with a high dry coating amount.

Boric acid or borate salt to be employed in the second surface treatment step can be similar to that employed in the formation of the ink receiving layer or in the first surface treatment step, but it is preferred to employ borax in consideration of the gelling or crosslinking rate in the aforementioned step of forming the ink receiving layer, the change in viscosity of the coating liquid for forming the ink receiving layer during the use thereof, and suppression of the crack generation in the formed ink receiving layer. In the second surface treatment step, it is preferred to employ such a coating amount that the coating liquid does not overflow from the substrate after the first surface treatment. Though dependent on the absorbability of the substrate after the first surface treatment, it is preferred to make an adjustment since an overflowing state of the coating liquid for the second surface treatment may cause a floating state of the coating liquid for the ink receiving layer at the coating thereof, thereby deteriorating the adhesion of the ink receiving layer to the substrate.

It is also preferred, in the second surface treatment step, to adjust the solid concentration of one or more substances selected from the group of boric acid and borate salts so as to obtain a dry coating amount of 0.05 to 2.0 g/m$^2$ in terms of borax solid. In the second surface treatment step, a coating liquid containing one or more compounds selected from the group of boric acid and borate salts, for example a 5% aqueous solution of borax, is applied on the undercoat layer already subjected to the first surface treatment. The coating liquid may further include a solvent such as alcohol for defoaming if necessary.

Dry coating amounts of the coating liquids applied in the first and second surface treatment steps can be suitably determined from the relationship of the first surface treatment step and the second surface treatment step. For example, in case the coating amount of the first surface treatment step is reduced, a compensation can be made by increasing the coating amount in the second surface treatment step. However, it is preferred to select the dry coating amount in the first surface treatment step from 0.1 to 1.0 g/m$^2$ in consideration of the ease of control on the coating amount and the relation with the coating amount in the succeeding second surface treatment step, and to select the dry coating amount in the second surface treatment step from 0.3 to 1.5 g/m$^2$ in consideration of the coating speed and the relation with the coating amount in the first surface treatment step. The aforementioned moist surface is not a uniform surface but is made to have recesses for the coating liquid, and the crosslinking of the binder is caused in such recesses to secure the adhesion and the anchoring effect for the ink receiving layer to the substrate. Such construction having the crosslinked binder in the recess is effective also for the formed recording medium. In the preparation of the coating liquid for the ink receiving layer, there is preferably employed a mixing apparatus which mixes one or more compounds selected from the group of boric acid and borate salts with an alumina hydrate dispersion, and mixes the thus obtained mixture liquid with an aqueous solution of polyvinyl alcohol constituting the binder immediately prior to the coating thereby obtaining a coating liquid. In this manner it is possible to reduce the viscosity increase with time or the gelation appearing in the course of manufacturing process, thereby improving the production efficiency. In the above-mentioned alumina hydrate dispersion, the pigment preferably has a solid concentration of 10 to 30 mass %. A concentration exceeding such range increases the viscosity of the pigment dispersion and that of the ink receiving layer, whereby a difficulty may arise in the coating property.

In the undercoat layer to be explained later and in the aforementioned ink receiving layer, there may be suitably contained, if necessary, various additives such as a pigment dispersant, a viscosifier, a fluidity improving agent, a defoamer, an antifoamer, a releasing agent, a permeation agent, a coloring pigment, a coloring dye, a fluorescent whitening agent, an ultraviolet absorber, an antioxidant, an antiseptic, an antimold agent, a water resistant agent, a dye fixing agent etc.

The formation of the ink receiving layer in the recording medium is presumed to be based on the following phenomena. It is firstly presumed that a reaction of boric acid or borate salt, employed in the surface treatment of the substrate, with polyvinyl alcohol in the coating liquid for the ink receiving layer, namely a geletion and/or a crosslinking reaction, (1) suppresses the permeation of polyvinyl alcohol into the undercoat layer, whereby the binder can be distributed relatively uniformly in the ink receiving layer, and, in a drying step in the formation of the ink receiving layer, (2) a movement of the coating liquid can be reduced by a viscosity increase owing to the gelation and/or the crosslinking reaction. Particularly in case of employing alumina hydrate for forming the ink receiving layer, it is presumed that a crosslinking reaction of alumina hydrate and boric acid or borate salt generates so-called inorganic polymers, and the interaction of boric acid or borate salt, alumina hydrate and polyvinyl alcohol functions effectively for suppressing crack formation in the ink receiving layer.

The substrate to be employed in the embodiment relating to the ink receiving layer is not particularly restricted as long as it accepts a surface treatment to be explained later, but in case of forming a glossy surface by applying a cast step to the surface of the recording medium, there is preferred a fibrous substrate, namely a paper substrate because water or a solvent component evaporates from the rear surface of the substrate. The paper substrate includes a base paper subjected to a sizing with starch, polyvinyl alcohol etc., and a coated paper such as art paper, coated paper or cast coat paper prepared by forming a coated layer on such base paper.

In case of forming a glossy surface by applying a cast step to the surface of the recording medium, it is preferred that the paper substrate is provided thereon with a coated layer of such a thickness as to completely cover the cellulose pulp fibers and the texture of the paper substrate (base paper), as an undercoat layer for the ink receiving layer. In case such covering is not attained, there may easily arise a coating unevenness (streak defect etc.) derived from such fibers or texture, and the cellulose pulp fibers are present in the ink receiving layer, on the surface thereof or in the vicinity of such surface whereby, even in case of applying the cast process to the surface of the recording medium, it is difficult to obtain a satisfactorily uniform cast surface, namely a photograph-like highly glossy surface. In order to cover the cellulose pulp of the paper substrate, the coated layer preferably has a dry coating amount of 10 g/m$^2$ or higher, more preferably 15 g/m$^2$ or higher. A dry coating amount less 10 g/m$^2$ is insufficient for completely covering the cellulose pulp or the texture of the substrate, whereby the glossiness may be affected.

The undercoat layer can be formed with a coating liquid containing the pigment and the binder, but preferably has an ink receiving property. The undercoat layer can be formed in one or more layers at least on a surface of the substrate. In consideration of stability of environmental curling of the recording medium, the undercoat layer is preferably formed on both sides of the substrate. The substrate to be employed in the embodiment relating to the ink receiving layer includes a paper substrate provided with the aforementioned undercoat layer. Also in consideration of the evaporation of water or solvent component from the rear surface of the substrate in the cast step, the coating property (wetting property) of the coating liquids to be applied on the substrate in the first and second surface treatment steps to be explained later, and the coating property of the material for forming the ink receiving layer on the substrate, the substrate preferably has a permeability (JIS P 8117) of 1,500 to 5,000 seconds. In case the permeability is less than the above-mentioned range, the substrate has a low density, so that the crosslinking agent (boric acid or borate salt) in the first and second surface treatment steps shows a high penetration and may not function effectively in its entirety. Otherwise there is required a higher coating amount. Also in the second surface treatment step, there is preferred a coated state causing a penetration without overflowing, but the adjustment of the coating amount is difficult and it is difficult to obtain stable coating with time, over the entire area in the cross-direction and machine-direction.

On the other hand, in case the permeability of the substrate exceeds the aforementioned range, the coating liquids to be applied in the first and second surface treatment steps to be explained later show limited permeation, whereby the coating liquid for the ink receiving layer, applied thereon, may become floated by the overflowing of the coating liquid employed in the second surface treatment or the formed ink receiving layer may generate slight cracks. Also at the cast step, a satisfactory glossy surface may become difficult to obtain because the evaporation of water or solvent component from the rear surface of the substrate becomes difficult. For similar reasons, it is advantageous to employ a substrate having a Stöckigt sizing degree within a range of 100 to 400 seconds and a Bekk smoothness within a range of 100 to 500 seconds. Also in order to obtain a recording medium comparable in quality feeling to the silver halide photograph, it is preferred to employ a substrate of a basis weight of 160 to 230 g/m$^2$ and a Gurley stiffness of 7 to 15 mN.

In the following there will be explained material for forming the ink receiving layer, to be employed in the embodiment relating to the ink receiving layer.

The ink receiving layer can be formed by applying a coating liquid including a pigment and a binder. It is particularly preferred to include alumina hydrate as a principal component in consideration of dye fixing property, transparency, print density, color forming ability and glossiness, but there can also be employed an inorganic pigment such as light calcium carbonate, heavy calcium carbonate, magnesium carbonate, caolin, aluminum silicate, diatomaceous earth, calcium silicate, magnesium silicate, synthetic amorphous silica, colloidal silica, alumina, or magnesium hydroxide; or an organic pigment such as styrenic plastic pigments, acrylic plastic pigments, polyethylene particles, microcapsule particles, urea resin particles or melamine resin particles.

As alumina hydrate, there can be advantageously employed a material represented by the following general formula (1):

$$Al_2O_{3-n}(OH)_{2n}.mH_2O \quad (1)$$

wherein n represents 0, 1, 2 or 3; m represents a value of 0 to 10, preferably 0 to 5, but m and n are not 0 at the same time. Since $mH_2O$ represents a cleavable water phase not involved in many cases in the crystal lattice formation, m can be an integral or non-integral value, and may reach 0 when such material is heated.

The alumina hydrate can be produced by a known method such as a hydrolysis of aluminum alkoxide or sodium aluminate as described in U.S. Pat. Nos. 4,242,271 and 4,202,870, or by a neutralization of an aqueous solution of sodium aluminate etc. with an aqueous solution of aluminum sulfate or aluminum chloride, as described in Japanese Patent Publication No. 57-447605. In the embodiment relating to the ink receiving layer, there is advantageously employed an alumina hydrate showing a boemite structure or an amorphous structure in the X-ray diffraction analysis, particularly that described in Japanese Patent Application Laid-open Nos. 7-232473, 8-132731, 9-66664 and 9-76628.

In case of executing the cast step by moistening the ink receiving layer by a rewetting method in order to provide the surface of the recording medium with glossiness, it is preferred to employ alumina hydrate of platelet shape with a low orienting tendency. The platelet-shaped alumina hydrate, showing a high water absorption and allowing easy penetration of the rewetting solution, causes the swelling of the ink receiving layer, whereby the alumina hydrate particles can be easily rearranged. It is therefore possible to obtain a high gloss. Also the production efficiency at the cast step is improved because of the efficient penetration of the rewetting solution.

In the embodiment relating to the ink receiving layer, polyvinyl alcohol is employed as a binder for the coating liquid for forming the ink receiving layer. The content of polyvinyl alcohol is preferably from 5 to 20 mass % with respect to alumina hydrate. Also an already known binder may be employed in combination with polyvinyl alcohol, as the binder to be used for forming the ink receiving layer in the embodiment relating to the ink receiving layer.

For the formation of the ink receiving layer, it is extremely effective to include at least one substance selected from the group of boric acid and borate salts in the material for forming the ink receiving layer in the above-described manner. The boric acid employable for this purpose is not limited to orthoboric acid ($H_3BO_3$) but also includes metaboric acid and hypoboric acid. The borate salt is preferably a water-soluble salt of boric acid mentioned above, and specific examples include alkali metal salts of boric acid such as sodium salts ($Na_2B_4O_7.10H_2O$, $NaBO_2.4H_2O$ etc.), or potassium salts ($K_2B_4O_7.5H_2O$, $KBO_2$ etc.), and ammonium salts of boric acid ($NH_4B_4O_9.3H_2O$, $NH_4BO_2$ etc.), and alkali earth metal salts such as magnesium salts or calcium salts of boric acid.

It is preferred to employ orthoboric acid in consideration of the stability with time of the coating liquid and the suppression of crack generation. It is also preferably employed within a range of 1.0 to 15.0 mass % in solid boric acid with respect to polyvinyl alcohol in the ink receiving layer. Even within this range, crack generation may take place and a selection of the condition is therefore necessary. Also a content exceeding this range deteriorates the stability with time of the coating liquid and is therefore undesirable. More specifically, since the coating liquid is used over a prolonged period in production, a high content of boric acid induces a viscosity increase in the coating liquid or a gelation during such period, thereby frequently requiring a replacement of the coating liquid or a cleaning of the coater head, thus significantly deteriorating the productivity. Also a content exceeding the aforementioned range tends to generate spot-shaped defects on the surface (cast surface) in the cast process for the same reasons as in the first and second surface treatments to be explained later, whereby a uniform and satisfactory glossy surface may not be obtained.

The ink receiving layer thus formed preferably has pore properties meeting the following conditions, in order to achieve objects and effects of a high ink absorbing property and a high fixing ability. At first, the ink receiving layer preferably has a pore volume within a range of 0.1 to 1.0 $cm^3/g$. A pore volume less than this range cannot provide a sufficient ink absorbing property, thus providing an ink receiving layer of an inferior ink absorbing property, in which the ink may overflow in certain cases to generate a bleeding in the image. On the other hand, a pore volume exceeding this range tends to generate cracks or a powder falling in the ink receiving layer. Also the ink receiving layer preferably has a BET specific surface area of 20 to 450 $m^2/g$. In case the surface area is less than this range, a sufficient gloss may not be obtained and the image may appear hazily white because of increased haze (lowered transparency). Also in such case, the dye absorbability may become undesirably low. On the other hand, a surface area exceeding the above-mentioned range may tend to generate cracks in the ink receiving layer. The pore volume and the BET specific surface area can be determined by a nitrogen adsorption-desorption method.

Also in forming the ink receiving layer, the producing method according to the embodiment relating to the ink receiving layer can be applied to increase freedom on the thickness of the ink receiving layer in comparison with that in the prior technology, namely to obtain a thicker layer in comparison with the prior technology. In consideration of a high ink absorbing property, there is preferred a dry coating amount of 30 to 50 $g/m^2$. A coating amount less than such range is undesirable as it cannot provide a sufficient ink absorbing property, resulting in an ink overflow and causing a bleeding phenomenon or resulting in a diffusion of the ink dye even to the substrate thereby reducing the print density, particularly in a printer employing plural pale-colored inks in addition to three-color inks of cyan, magenta and yellow and a black ink. A coating amount exceeding 30 $g/m^2$ is preferred as it can provide an ink receiving layer showing a satisfactory ink absorbing property even under a high-temperature high-humidity environment, and, at a dry coating amount equal to or less than 50 $g/m^2$, the coating unevenness decreases in the ink receiving layer which can therefore be produced with a stable thickness.

Boric acid or borate salt to be contained in the coating liquids for the first and second surface treatment steps in the embodiment relating to the ink receiving layer can be similar to that employed in the formation of the ink receiving layer. In consideration of the suppressing effect against crack generation, it is preferred to include borax (sodium tetraborate).

Each of the coating liquids for the ink receiving layer and the surface treatment steps explained in the foregoing is coated on on-machine or off-machine process so as to obtain an appropriate coating amount mentioned in the foregoing, suitably selecting various coating devices such as a blade coater, a roll coater, an air knife coater, a bar coater, a rod blade coater, a curtain coater, a gravure coater, an extrusion coater, a slide hopper coater or a size press. At the coating operation, it is possible to heat the coating liquid or to heat the coating head for the purpose of viscosity adjustment of the coating liquid.

The drying after coating can be executed by suitably selecting, for example, a hot air dryer such as a straight tunnel dryer, an arch dryer, an air loop dryer or a sinusoidal curve air float dryer, an infrared heating dryer or a microwave dryer.

After the ink receiving layer is formed in the above-described manner, a glossy surface can be formed thereon by a cast process, as will be explained in the following.

The cast process is a method of pressing the ink receiving layer in a moistened state or in a plastic state to a surface of a heated drum (casting drum) having a mirror surface, and drying the layer in the pressed state thereby transferring the mirror surface to the surface of the ink receiving layer, and is representatively divided into a direct process, a rewetting (indirect) process and a solidification process.

Any of these cast processes can be utilized, but, in the embodiment relating to the ink receiving layer, it is preferred to employ alumina hydrate in the ink receiving layer of the recording medium, and the rewetting cast process is particularly preferred in such case since it can provide a high gloss.

In the producing method for the recording medium in the embodiment relating to the ink receiving layer, it is also possible to add a step of forming a rear layer on the rear surface (opposite to the surface on which the ink receiving layer is formed) of the substrate, thereby producing a recording medium having a rear layer. The formation of the rear layer is effective for reducing a curl generated prior to or after printing.

In consideration of the effect for reducing the curl generation, there is preferred a layer which generates, upon absorbing moisture, a shrinkage similar to that in the undercoat layer and/or the ink receiving layer on the top surface of the substrate, and it is preferred to employ a pigment and a binder similar to those employed in these layers. It is more preferred to employ a pigment and a binder similar to those employed in the thicker ink receiving layer. The rear layer may be formed before or after the first surface treatment, after the formation of the ink receiving layer or after the cast process.

Also in the case of producing the recording medium of the embodiment relating to the ink receiving layer, it is also possible, if necessary, to provide another layer such as the aforementioned undercoat layer, between the rear layer and the substrate. In such case it is also possible to form a glossy surface on the rear surface, thereby obtaining a recording medium having glossy surfaces on both the front surface and the rear surface. Also two-side printing is possible by giving a printing ability on the rear layer, or the rear layer and/or the another layer.

Figure 4:
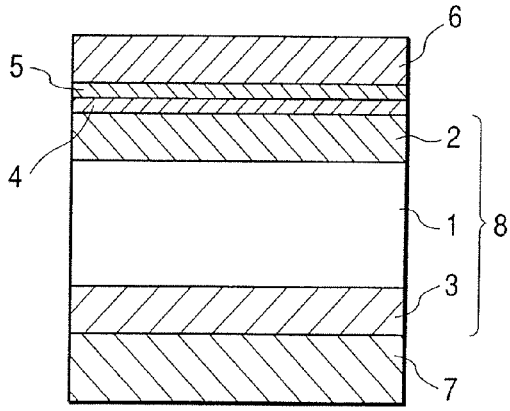
FIG. 4 is a schematic view showing the configuration of a recording medium produced by the producing method for a recording medium in an embodiment relating to the ink receiving layer.

Also in the formation of the rear layer, in order to suppress crack generation as in the ink receiving layer, it is possible to execute the first surface treatment/second surface treatment/rear layer formation on the rear surface of the substrate, namely to execute the first surface treatment and then the second surface treatment, then to apply a coating liquid for the rear layer while the substrate maintains a moist state and to dry such coating liquid. However, either one of the first surface treatment and the second surface treatment may be enough in certain cases (depending on the state of crack generation on the rear layer). FIG. 4 is a schematic cross-sectional view showing a preferred example of the construction of the recording medium produced as explained in the foregoing. The construction includes a base paper 1; an undercoat layer 2 containing a pigment, a binder etc.; an undercoat layer 3; a surface treatment 4 prepared by applying and drying a borax-containing coating liquid; a surface treatment 5 prepared by applying a borax-containing coating liquid; an ink receiving layer 6 (containing alumina hydrate, polyvinyl alcohol, boric acid etc.) prepared by applying and drying a coating liquid while the undercoat layer/base paper maintain a moist state by the surface treatments; and a rear layer 7 including a pigment, a binder etc. The base paper 1 and undercoat layers 2 and 3 constitute a substrate 8.

Referring to FIGS. 2 and 3, the recording medium is featured in that the ink receiving layer includes a first layer region in which the binder is crosslinked with a second crosslinking agent and is homogenized relative to the pigment, and a second layer region in which the binder is crosslinked by a first crosslinking agent so as to have a higher crosslinking degree than in the first layer region, and that the first layer region is positioned closer to the ink recording surface than the second layer region. This is a novel recording medium, in which the aforementioned loss of the binder is prevented and pores formed by the pigment aggregated by the crosslinked binder of the higher crosslinking degree are formed stably also in the second layer region, whereby the recorded ink can be adequately absorbed in the ink receiving layer and sharp image formation can be attained without ink diffusion to the surrounding area.

The crosslinking degree in the second layer region substantially intensifies the crosslinking of the binder, so that the dispersion state of the binder at the interface is made uniform, without formation of extremely concentrated areas or extremely deficient areas, thereby preventing unnecessary passage of the binder itself and providing an anchoring effect of the binder in case the interface has irregularities. The aforementioned crosslinking degree can be judged by a relative difference in quantity or a ratio thereof of an element common to the second crosslinking agent and the first crosslinking agent (for example boron "B") respectively contained in the first layer region and the second layer region (for example a ratio of five times or higher). Also specific materials and producing method can be represented by that the recording medium is formed by applying a coating liquid, prepared by mixing and dissolving alumina hydrate as the pigment, polyvinyl alcohol as the binder and orthoboric acid as the second crosslinking agent, on a moist surface containing a tetraborate salt as the first crosslinking agent for forming the second layer region. Also as a practical example, in such coating liquid the content of orthoboric acid per unit area is less than the content of sodium tetraborate per unit area in the moist surface.

Thus, there is provided a recording medium including an ink receiving layer containing at least a pigment capable of holding the coloring agent of the ink and showing a viscosity change in response to pH, and a binder for the pigment, the recording medium being featured in that the ink receiving layer includes a first layer region in which the binder is crosslinked with a second crosslinking agent of a pH value capable of maintaining the pigment at a low viscosity, and a second layer region in which the binder is crosslinked by a first crosslinking agent of a pH value capable of maintaining the pigment at a high viscosity, and that the first layer region is positioned closer to the ink recording surface than the second layer region. Based on the relationship of the pigment and the first and first crosslinking agents constituting the ink receiving layer, a pH change is made to provide a high viscosity in the pigment and the second layer is reasonably formed by the binder which is progressively crosslinked by the crosslinking agent, whereby the formation of the excellent pore distribution and the binder crosslinked without loss enable appropriate absorption of the ink recorded in the ink receiving layer, and the ink and the coloring agent do not diffuse to the surrounding area in the ink receiving layer, thereby attaining a sharper image formation. The second layer region, having a larger crosslinking degree due to the first crosslinking agent than in the first layer region, can suppress the swelling of the entire ink receiving layer when the ink is supplied thereto, thus avoiding a change in the image. Such recording medium can be securely produced by a producing method featured in that "the pigment has a low viscosity at a relatively low pH value but changes to a high viscosity at a relatively high pH value, and the second layer region is formed by applying a coating liquid of a low pH value, prepared by mixing and dissolving the pigment, the binder and the second crosslinking agent, on a moist surface containing the first crosslinking agent and having a high pH value".

The recording medium featured in that the first layer region is positioned closer to the ink recording surface than the second layer region and has a high pH value is similar to the aforementioned second invention, but has an ink receiving layer having pores of uniform size formed by the pigment, utilizing the characteristics of the pigment to achieve binding by the crosslinked binder while accelerating the crosslinking of the binder by the crosslinking agent and the aggregation of the pigment, whereby the ink receiving layer shows a distribution of permeation stable in the direction of thickness thereby absorbing the recorded ink more appropriately without diffusion of the ink and the coloring agent to the surrounding area in the ink receiving layer, thus attaining an extremely sharp image formation. Particularly in order to prevent the loss of the binder of the coating liquid into the coated surface side and to achieve efficient removal of the solvent in the coating liquid, utilizing the reaction speed or the reaction state at the liquid-liquid contact interface, it is preferred that "the ink receiving layer is formed by applying a coating liquid, prepared by mixing and dissolving at least alumina hydrate as the pigment, polyvinyl alcohol as the binder and orthoboric acid as the second crosslinking agent for forming the first layer region, on a moist surface containing a tetraborate salt as the first crosslinking agent for forming the second layer region". Also for obtaining different crosslinking degrees, it is further preferred that the content of orthoboric acid in the coating liquid per unit area is less than the content of sodium tetraborate contained per unit area in the moist surface, or that the pigment is alumina hydrate, the binder is polyvinyl alcohol and the first and second crosslinking agents contain the same boron element "B" wherein the amount of boron "B" contained in the second layer region is two times or more of the amount of boron "B" contained in the first layer region.

The producing methods shown in FIGS. 2 and 3 include a step of applying a coating liquid, containing the pigment, the binder and the second crosslinking agent for crosslinking the binder, on a moist surface containing the first crosslinking agent for crosslinking the binder, wherein the crosslinking reaction by the first crosslinking agent at the contact interface between the coating liquid and the moist surface is accelerated in comparison with the crosslinking reaction by the second crosslinking agent in the coating liquid. This utilizes the reaction speed or the reaction state at the aforementioned liquid-liquid contact interface thereby enabling to produce the recording medium of a stable performance while preventing the loss of the binder of the coating solution into the coated surface side. As a result, there can be formed a first layer region in which the binder is crosslinked by the second crosslinking agent and is made relatively homogenized with the pigment, and a second layer region in which the binder is crosslinked by the first crosslinking agent so as to have a crosslinking degree higher than in the first layer region. More preferably, in addition to such construction, the aggregation of the pigment can be limited at the same time by "a method for producing a recording medium in which the pigment shows a viscosity change in response to pH, the second crosslinking agent provides a pH value capable of maintaining the pigment at a low viscosity, the first crosslinking agent provides a pH value capable of maintaining the pigment at a high viscosity, and a pH change is generated at the aforementioned contact interface to induce an aggregation of the pigment and a crosslinking of the binder". In this form, there is realized that "the first crosslinking agent is superior in the crosslinking reaction than the second crosslinking agent which is capable of crosslinking the binder", "the content of the second crosslinking agent per unit area in the afore mentioned coating liquid is smaller than the content of the first crosslinking agent per unit area in the aforementioned moist surface", or "the pigment is alumina hydrate, the binder is polyvinyl alcohol, the second crosslinking agent and the first crosslinking agent include the same boron element "B" and the amount of boton "B" contained in the second layer region is twice or more of the amount of boron "B" contained in the first layer region".

In the aforementioned embodiment relating to the ink receiving layer, since it is preferred, at the aforementioned crosslinking reaction, to exclude the liquid component such as the solvent (water in case of PVA (preferably purified water in order to avoid impurity for alumina)) for dissolving the binder of the coating liquid, the recording medium preferably includes, as the substrate for supporting the ink receiving layer, a porous member (paper, pulp, porous layer etc.) in which the liquid component of the coating liquid can permeate. In addition, in order to improve the adhesion and the strength of the ink receiving layer to the substrate (anchoring effect), it is also preferred that the aforementioned wet surface is not a smooth surface but have recesses for the coating liquid and cause a crosslinking of the binder in such recesses.

In the following, the present invention will be further clarified by examples and comparative examples, but the present invention is not limited by such examples. In the following description, "part" and "%" are based on mass unless otherwise specified.

EXAMPLE 1

Preparation of Substrate

A pulp slurry formed by 67 parts of leaf bleached kraft pulp (LBKP) with a freeness of 450 ml CSF (Canadian Standard Freeness), and 8 parts of needle bleached kraft pulp (NBKP) of with freeness 480 ml CSF was added with 0.4 parts of a paper strengthening agent (RB-151, manufactured by Harima Chemicals Co.) and 2 parts of aluminum sulfate and was adjusted to a pH value of 7.8, and a substrate was prepared.

Cationizing Treatment of Substrate

The obtained substrate was treated, on a surface on which an ink receiving layer was to be formed, with a cationic resin having a benzyl group and obtained in the following manner, so as to obtain an applied amount of 1 g/m$^2$ after drying. The cationic resin was obtained by dissolving 50.6 g of a 60% aqueous solution of methacryloyloxyethyl dimethylbenzylammonium chloride and 2.22 g of a 40% aqueous solution of acrylamide in 140 g of ion-exchanged water, then heating to 70° C. under nitrogen blowing, adding 10 g of a 0.1% aqueous solution of 2,2'-azobis(2-aminodipropane)hydrochloride and executing a reaction for 2 hours at 85° C.

Preparation of Coating Liquid for Undercoat Layer

On both sides of the substrate subjected to the aforementioned cationizing treatment, undercoat layers were formed with a coating liquid prepared in the following manner. A slurry with a solid concentration of 70%, containing 100 parts by mass of a filler formed by caolin (Ultra White 90, manufactured by Engelhard Ltd.)/zinc oxide/aluminum hydroxide with a weight ratio of 65/10/25 and 0.1 parts by mass of a commercially available polyacrylic acid-based dispersant, was added with 7 parts by mass of a commercially available styrene-butadiene latex and was adjusted to a solid content of 60% to obtain a coating liquid for the undercoat layer.

Coating of Coating Liquid for Undercoat Layer

The coating liquid obtained above was applied with a blade coater on both sides of the substrate so as to obtain a dry coating amount of 15 g/m$^2$ and was dried. Then a machine calender finishing (linear pressure 150 kgf/cm) was applied to obtain a substrate with a basis weight of 185 g/m$^2$, a Stöckigt sizing degree of 300 seconds, an air permeability of 3000 seconds and a Bekk smoothness of 180 seconds. This substrate was subjected to a cationizing treatment on one side with an undercoat layer thereon, and had the undercoat layers on both sides.

Surface Treatment of Undercoat Layer

The undercoat layer prepared as explained in the foregoing was subjected to a first surface treatment in the following manner. A coating liquid employed for the first surface treatment was a 5% aqueous solution of borax, heated to 30° C. This coating liquid was applied with a gravure coater on the undercoat layer at a speed of 60 m/min so as to obtain a dry coating amount of 0.4 g/m$^2$, and was then dried at 60° C.

Then the undercoat layer after the first surface treatment was subjected to a second surface treatment. The second surface treatment was executed by employing the same 5% borax aqueous solution heated to 30° C. as in the first surface treatment as a coating liquid and applying such coating liquid with an air knife coater at a speed of 30 m/min so as to obtain a wet coating amount of 10 g/m$^2$ (corresponding to a dry coating amount of 0.5 g/m$^2$). This coating amount, under visual observation, was such that the coating liquid did not overflow on the undercoat layer but just impregnated therein.

Preparation of Coating Liquid for Ink Receiving Layer

After the application of the coating liquid in the aforementioned second surface treatment, namely in a state in which the undercoat layer has been just impregnated with the coating liquid, an ink receiving layer was formed on the undercoat layer in the following manner.

At first, a coating liquid for forming the ink receiving layer was prepared by the following procedure. Disperal HP13 (manufactured by Sasol Co.) as alumina hydrate A was dispersed in purified water so as to obtain a solid content of 5 mass %, and the dispersion was adjusted to pH 4 with an addition of hydrochloric acid and agitated for a while. Then the dispersion was heated to 95° C. under agitation and was maintained at this temperature for 4 hours. The dispersion, while maintained at this temperature, was adjusted to pH 10 with sodium hydroxide, agitated for 10 hours, then returned to the room temperature and adjusted to a pH value of 7 to 8. It was then subjected to a desalting process and was deflocculated with an addition of acetic acid to obtain a colloidal sol. Alumina hydrate B, obtained by drying the colloidal sol, showed a boemite structure (pseudo boemite) in an X-ray diffraction analysis. It also showed a BET specific surface area of 143 g/m$^2$ and a pore volume of 0.8 cm$^3$/g. In an electron microscopic observation, it had a platelet shape with an average aspect ratio of 7.5 and a squareness of 0.7.

Separately, polyvinyl alcohol PVA117 (manufactured by Kuraray Inc.) was dissolved in purified water to obtain an aqueous solution of a solid content of 9 mass %. The colloidal sol of alumina hydrate B, obtained above, was concentrated to obtain a dispersion of 22.5 mass %, and a 3% aqueous solution of boric acid was added in such a manner that the boric acid solid corresponded to 0.50 mass % of the solid of alumina hydrate B. Then thus obtained alumina hydrate dispersion containing boric acid and the separately prepared aqueous solution of polyvinyl alcohol were mixed with a static mixer so as to obtain a ratio of 100:8 with respect to the alumina hydrate solid and the polyvinyl alcohol solid, thereby obtaining a coating liquid for the ink receiving layer.

Application of Coating Liquid for Ink Receiving Layer

The coating liquid for the ink receiving layer prepared as explained above, in a state immediately after the mixing of the alumina hydrate dispersion containing boric acid and the aqueous solution of polyvinyl alcohol, was applied with a die coater, on the undercoat layer of the side subjected to the cationizing treatment, with a speed of 30 m/min so as to obtain a dry coating amount of 35 g/m$^2$ and was dried at 170° C. to form an ink receiving layer.

Formation of Rear Layer

Also a rear layer was formed in the following manner, on the undercoat layer on a side of the substrate opposite to the ink receiving layer. Alumina hydrate Disperal HP13/2 (manufactured by Sasol Inc.) was dispersed in purified water so as to obtain a solid content of 18 mass %, and was then subjected to a centrifuging process. This dispersion and the same aqueous solution of polyvinyl alcohol as that employed in forming the ink receiving layer were mixed with a static mixer so as to obtain a ratio of 100:9 between the alumina hydrate solid and the polyvinyl alcohol solid, and the mixture was immediately applied with a die coater at a speed of 35 m/min so as to obtain a dry coating amount of 23 g/m$^2$ thereby forming a rear layer.

Formation of Glossy Surface

On the coated base paper (substrate) on which the ink receiving layer and the rear layer were formed as explained above, a glossy surface was formed in the following manner on the surface of the ink receiving layer. At first, for executing a rewetting cast process, water as a rewetting solution was uniformly applied to the aforementioned base paper to moisten at least the ink receiving layer. Then, in such moistened state, it was pressed to a cast drum heated to 100° C. and having a mirror surface and dried at a speed of 30 m/min, thereby obtaining a recording medium for ink of the present example, having a glossy surface on one side. This was regarded as a recording medium 1 for ink. A measurement of "N" distribution on a cross section thereof provided a distribution shown in FIG. 1.

EXAMPLE 2

A recording medium 2 for ink was prepared in the same manner as in the example 1, except that the cationizing treatment was so executed as to obtain a dry applied amount of 3 g/m$^2$.

EXAMPLE 3

A recording medium 3 for ink was prepared in the same manner as in the example 1, except that the cationizing treatment was so executed as to obtain a dry applied amount of 5 g/m$^2$.

EXAMPLE 4

A recording medium 4 for ink was prepared in the same manner as in the example 1, except that the cationizing treatment was so executed as to obtain a dry applied amount of 0.5 g/m$^2$.

EXAMPLE 5

A recording medium 5 for ink was prepared in the same manner as in the example 1, except that the cationizing treatment was so executed as to obtain a dry applied amount of 0.2 g/m$^2$.

EXAMPLE 6

A recording medium 6 for ink was prepared in the same manner as in the example 1, except that the cationizing treatment was executed with a cationic resin (trade name: Sanfix PAC-700 conc., manufactured by Sanyo Chemical Industries Co.).

COMPARATIVE EXAMPLE 1

A recording medium 7 for ink was prepared in the same manner as in the example 1, except that the cationizing treatment was not executed.

COMPARATIVE EXAMPLE 2

A recording medium 8 for ink was prepared in the same manner as in the example 1, except that the cationizing treatment was not executed, and that the cationic resin employed for the cationizing treatment in the example 2 was mixed in the coating liquid for the undercoat layer so as to obtain a solid ratio (cationic resin/undercoat layer solid matter) of 5/100.

COMPARATIVE EXAMPLE 3

The cationizing treatment was not executed, and the cationic resin employed for the cationizing treatment in the example 2 was mixed in the coating liquid for the ink receiving layer so as to obtain a solid ratio (cationic resin/undercoat layer solid matter) of 5/100. However the coating liquid for the ink receiving layer caused gelation and coagulation, so that the ink recording medium could not be prepared.

Evaluation

The recording media for ink 1 to 8, obtained in the foregoing examples and comparative examples, were evaluated by the following methods and criteria. Obtained results of evaluation are summarized in Table 1.

Surface Property

Presence (yes) or absence (none) of crack generation on the surface of the ink receiving layer was confirmed by visual observation.

Mirror Surface Glossiness

A mirror surface glossiness was measured at 20° and 75°, by a gloss measuring meter (trade name: VG2000, manufactured by Nihon Denshoku Kogyo Co.).

Moisture Resistance 1 of Image

White characters "○Δ□" were printed on a solid blue area (cyan 100%+magenta 100%) formed on each of the recording media for ink 1 to 8 for ink with BJF900 (trade name, manufactured by Canon Inc.), and the obtained print was let to stand for 7 days in an environment of 23° C./80%. After the standing, a state showing remaining white characters was evaluated as rank A, a state with illegible white characters was evaluated as rank C, and an intermediate state was evaluated as rank B.

Moisture Resistance 2 of Image

An evaluation was made in the same method and the same criteria as in the above moisture resistance 1, except that the ink recording medium after image formation was let to stand in an environment of 30° C./80%.

Light Fastness of Image

On each of the recording media for ink 1 to 8 for ink, 100% print areas of black, cyan, magenta and yellow of 3 cm square each were printed with BJF900 (trade name, manufactured by Canon Inc.), and the obtained print was subjected to an accelerated deterioration test with a light fastness tester (trade name: Ci-4000, manufactured by Atlas Electric Device Company). The light fastness tester was set at conditions of a black panel temperature: 55° C., an illumination intensity: 0.39 W/m$^2$, an in-chamber temperature: 45° C., an in-chamber humidity: 60% RH, and a test period of 24 hours. The image density of the print was measured before and after the light fastness test and a retention rate was calculated as follows. The image density was measured with a Macbeth densitometer (trade name: RD-918, manufactured by Kollmorgen Corporation):

Retention rate (%)=(image density after test)/(image density before test)×100

TABLE 1

Results of evaluation

| | Surface property | Mirror surface glossiness 20° | Mirror surface glossiness 75° | Moisture resistance 1 | Moisture resistance 2 | Light fastness (retention rate %) black | cyan | magenta | yellow |
|---|---|---|---|---|---|---|---|---|---|
| Ex. 1 | none | 35 | 74 | A | A | 77 | 94 | 78 | 81 |
| Ex. 2 | none | 30 | 72 | A | A | 76 | 93 | 76 | 81 |
| Ex. 3 | none | 28 | 68 | A | A | 70 | 90 | 70 | 78 |
| Ex. 4 | none | 34 | 74 | A | A | 77 | 94 | 78 | 81 |
| Ex. 5 | none | 34 | 73 | A | B | 78 | 95 | 80 | 81 |
| Ex. 6 | none | 33 | 73 | A | A | 76 | 92 | 77 | 80 |
| Comp. Ex. 1 | none | 33 | 74 | C | C | 80 | 96 | 84 | 81 |
| Comp. Ex. 2 | none | 25 | 65 | B | B | 77 | 93 | 74 | 78 |
| Comp. Ex. 3 | — | — | — | — | — | — | — | — | — |

The amount of boron "B" in the first layer region was $2.61\times10^{-3}$ mol/m$^2$, while that in the second layer region was $9.94\times10^{-3}$ mol/m$^2$, so that the amount of boron "B" in the second layer region was 3.8 times of that in the first layer resion. In the present examples, there is required a quantitative relationship of 2 times or higher.

The amount of boron "B" contained in the first layer region was calculated by the following formulas:

(dry coating amount of ink receiving layer: 35)×(amount of boric acid: 22.5×0.5%)/{(amount of boric acid: 22.5×0.5%)+(amount of PVA: 22.5×8/100)+(amount of alumina hydrate: 22.5)}=0.16 g/m$^2$ 0.16/(molecular weight of boric acid: 61.8)=$2.61\times10^{-3}$ mol/m$^2$.

Also the amount of boron "B" contained in the second layer region was calculated by a following formula:

{(dry coating amount of second surface treatment: 0.5)/(molecular weight of borax: 201.2)}×(molar amount of B per 1 mole of borax: 4)=$9.94\times10^{-3}$ mol/m$^2$.

In the foregoing, the molecular weight of borax was calculated for $Na_2B_4O_7$ since borax was in an impregnated state in the undercoat layer and not in a dried state.

As will be apparent from the foregoing examples, the borax salt is superior in the crosslinking property to orthoboric acid, and is different in quantity even after drying. Also alumina hydrate used as a pigment shows a rapid viscosity change at about pH 7, showing a low viscosity at the acidic side and a high viscosity at the alkaline side. Also an aqueous solution of the borax salt is alkaline, while an aqueous solution of orthoboric acid is acidic. Besides the coating liquid for forming the ink receiving layer is acidic and dissolves alumina hydrate while the reaction at the aforementioned liquid-liquid interface changes at about pH 7, so that the crosslinking reaction of PVA securely takes place and the alumina hydrate causes a viscosity increase and aggregation whereby water (preferably purified water for preventing impurity for alumina) as the solvent is separated from the PVA serving as the binder and penetrates into the substrate. A pH measurement on a cross section of the prepared ink receiving layer showed a pH value of 6.2 to 6.4 in the first layer region (for example at the surface) in the embodiment relating to the ink receiving layer, while a pH value of about 6.8 in the second layer region.

Thus the examples shown above realizes the inventions in the embodiment relating to the ink receiving layer and exhibits the effects thereof.

The effect of the embodiment relating to the ink receiving layer can be further enhanced when applied in a recording medium for recording ink droplets as an image, in a recording head or a recording apparatus of a bubble jet method among the ink jet recording methods. As to its representative configuration and principle, for example the one practiced by the use of the basic principle disclosed in the U.S. Pat. Nos. 4,723,129 and 4,740,796 is preferred. This system is applicable to either of the so-called on-demand type and the continuous type. Particularly the case of the on-demand type is effective because, by applying at least one driving signal which gives rapid temperature elevation exceeding nucleus boiling corresponding to the recording information on an electrothermal converting member arranged corresponding to the sheets or liquid channels holding ink, thermal energy is generated at the electrothermal converting member to induce film boiling at the heat action surface of the printing head, and a bubble can be consequently formed in the ink in one-to-one response to the driving signals. By discharging the ink through a discharge aperture by the growth and shrinkage of the bubble, at least a droplet is formed. By forming the driving signals into pulse shapes, growth and shrinkage of the bubble can be effected instantly and adequately to accomplish more preferable discharging of the ink particularly excellent in the response characteristics. As for the driving signals of such pulse shapes, those disclosed in the U.S. Pat. Nos. 4,463,359 and 4,345,262 are suitable. Further excellent recording can be performed by employment of the conditions described in the U.S. Pat. No. 4,313,124 of the invention concerning the temperature elevation rate of the above-mentioned heat action surface.

POSSIBILITY OF INDUSTRIAL APPLICATION

As explained in the foregoing, the present invention provides an ink recording medium having an ink absorbing ability of absorbing a large amount of ink at a high speed, excellent in a color forming property and capable of forming a high quality image, and a producing method for such ink recording medium. In particular, the present invention provides an ink recording medium capable of suppressing an image deterioration by a dye displacement which tends to take place in case the image is maintained in a high humidity condition and an image deterioration by light appearing in case the image is displayed, and excellent in the stability in time of the printed image, and a producing method for such ink recording medium.

What is claimed is:

1. A method for producing a recording medium for ink including an ink receiving portion for receiving an ink and holding a coloring agent in the ink, the method comprising:

a first step of applying, on a support member on which a cationic substance is formed, an aqueous liquid including a component for forming a porous layer;

a second step of applying, on said porous layer, a first crosslinking agent for crosslinking binders; and a third step of forming, on the surface on which said first crosslinking agent is formed, an ink receiving layer containing at least a pigment for holding the coloring agent of the ink, and a binder for said pigment.

2. A method for producing a recording medium for ink according to claim 1, wherein said third step includes a step of applying a coating liquid containing said pigment, said binder, and a second crosslinking agent for crosslinking said binder on a moist surface which is the surface on which said first crosslinking agent is applied, and wherein a crosslinking reaction by the first crosslinking agent at a contact interface between said coating liquid and said moist interface is accelerated more than a crosslinking reaction by said second crosslinking agent in said coating liquid.

3. A method for producing a recording medium for ink according to claim 2, wherein said pigment shows a viscosity change in response to a pH value, said second crosslinking agent provides a pH value for maintaining said pigment at a low viscosity, said first crosslinking agent provides a pH value for maintaining said pigment at a high viscosity, and a pH change is generated at said contact interface to cause an aggregation of the pigment and a crosslinking of said binder.

4. A method for producing a recording medium for ink comprising:

a step of forming a cationic substance on a surface of a support member;

a step of applying an aqueous liquid containing a component capable of forming a porous layer on a surface on which said cationic substance is formed;

a first surface treatment step of applying, drying and solidifying a first coating liquid containing at least a crosslinking agent selected from the group consisting of boric acid and borate salts on said porous layer;

a second surface treatment step of applying a second coating liquid containing at least one compound selected from the group consisting of boric acid and borate salts on a solidified surface formed in said first surface treatment step; and a step of applying a third coating liquid containing at least a pigment, polyvinyl alcohol and at least one crosslinking agent selected from the group consisting of boric acid and borate salts while said second coating liquid maintains a moist state.

5. A method for producing a recording medium for ink according to claim 4, wherein said pigment includes alumina hydrate and said ink receiving layer is 30 $g/m^2$ or higher.

6. A method for producing a recording medium for ink according to claim 4, further comprising a step of casting the ink receiving layer obtained after said step of applying the third coating liquid.

7. A method for producing a recording medium for ink according to claim 4, wherein said recording medium for ink includes a porous member in which a liquid component of said coating liquid can permeate, as a substrate for supporting said ink receiving layer.

8. A method for producing a recording medium for ink according to any of claims 4 to 7, wherein said moist surface is not a uniform surface but has a recess for said coating liquid and crosslinking of said binder is in said recess.

* * * * *